United States Patent [19]

Malpas

[11] 4,274,554

[45] Jun. 23, 1981

[54] PACKAGING OF LIQUIDS

[76] Inventor: Charles H. Malpas, P.O. Box 10, Leopold, 3221, Victoria, Australia

[21] Appl. No.: 910,764

[22] Filed: May 30, 1978

[30] Foreign Application Priority Data

Jul. 11, 1977 [AU] Australia ..... PD0781
Aug. 10, 1977 [AU] Australia ..... PD1177

[51] Int. Cl.[3] ..... B65D 35/08

[52] U.S. Cl. ..... 222/107; 222/541; 53/477

[58] Field of Search ..... 53/477, 469; 222/107, 222/90, 541, 89, 91; 150/8, 2.1

[56] References Cited

U.S. PATENT DOCUMENTS

| | | | |
|---|---|---|---|
| 2,861,718 | 11/1958 | Winzen | 222/107 |
| 3,081,911 | 3/1963 | Scholle | 222/107 |
| 3,205,889 | 9/1965 | Alder et al. | 222/107 X |
| 3,245,200 | 4/1966 | Shaw | 53/512 |
| 3,306,327 | 2/1967 | Ilg | 150/2.1 |
| 3,922,099 | 11/1975 | Christine et al. | 222/91 |

*Primary Examiner*—Stanley H. Tollberg

[57] ABSTRACT

An inner container for a composite container for liquids in accordance with the known art, the improvement comprising a flexible bag-like container sealed around its periphery and having two socket members, one having the material of the container extending across its inner end as a frangible diaphragm, and the other providing a frangible diaphragm which, when broken, will permit the container to be filled with liquid, the two sides of the bag-like container being then sealed together to close the container.

4 Claims, 10 Drawing Figures

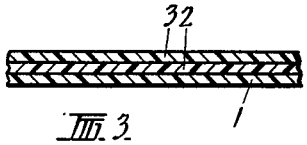
Фиг. 3
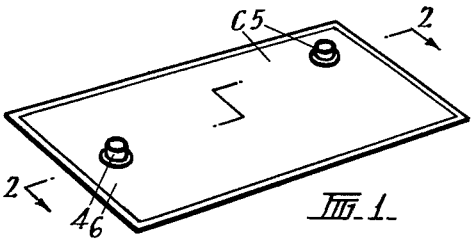
Фиг. 1
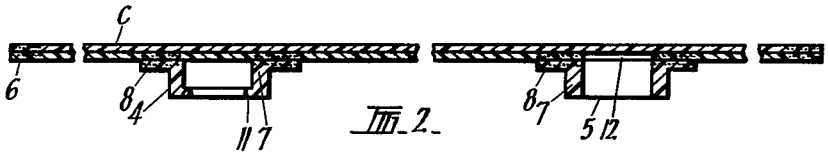
Фиг. 2
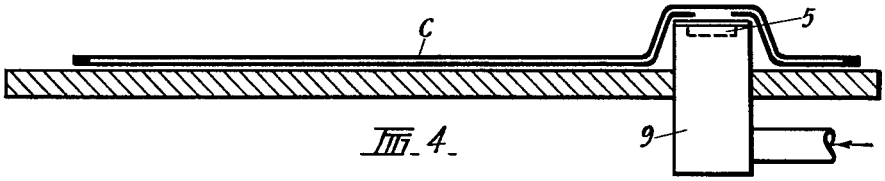
Фиг. 4
Фиг. 5
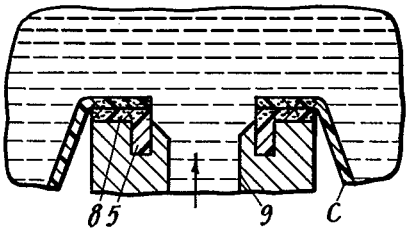
Фиг. 6
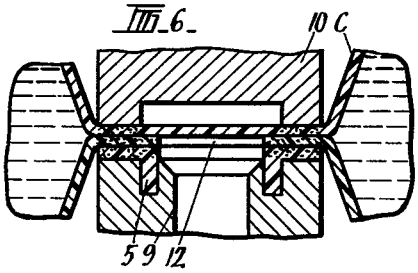
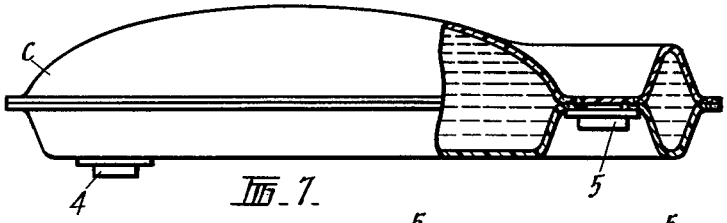
Фиг. 7
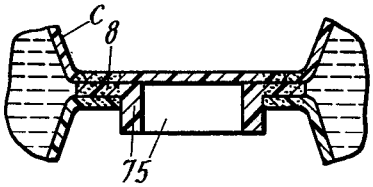
Фиг. 8
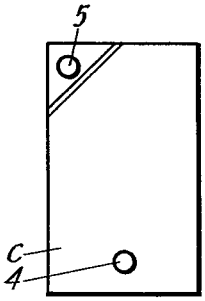
Фиг 9
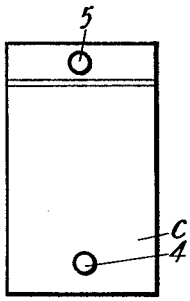
Фиг. 10

PACKAGING OF LIQUIDS

This invention relates to improvements in the packaging of liquids and it refers particularly to the packaging of liquids by means of a composite container consisting of an outer container and an inner container connected together by socket means for receiving a tap for dispensing the liquid contents of the inner container.

Composite containers of this general character are described in the U.S. Pat. Nos. 3,448,889 and 3,642,172 of C. H. Malpas. In each of these patents there is disclosed an outer container of relatively rigid material—which may be tinplate, cardboard, or a suitable plastics material—having fitted to it at a convenient location near the bottom of the container a socket member for the reception of a tap or spigot for dispensing the contents, and a flexible inner container for holding the liquid to be contained in the composite container. The flexible inner container is made of plastics materials of such nature that there will be no reaction between the plastics material and the liquid contents and there will be as small as possible a transmission of air or oxygen to the contents, whereby to prevent or delay deterioration of the contents, and it is fastened to the inner end of the socket member by a separate clamping ring engaged with the inner container and inner end of the socket member after the inner container has been placed within the outer container and before filling the inner container with the liquid contents.

In these constructions one end of the inner container was open initially, to enable the inner container to be secured in position and to be filled with liquid, and after the inner container had been filled that end of the container was closed and sealed. In consequence, the liquid fed into the inner container was open to air during the filling operation and until the end of the inner container had been closed and sealed. In that latter operation it was very difficult, and commercially not possible, to exclude all the air from within the inner container prior to sealing the end closed, with the result that a small amount of air would remain in contact with the liquid contents after the inner container had been closed and sealed.

Also, the clamping ring was placed inside the inner container and then, when the inner container had been fitted in correct position adjacent the inner end of the socket member, pressed over the relevant part of the inner container and the socket member, in order to clamp the inner container on to the socket member. This provided an opportunity for the interior of the inner container to be contaminated.

Composite containers of this nature are well suited for the sale of many liquids, including milk, wines, and other liquids which may deteriorate if allowed to come into contact with air, as well as whiskey and other alcoholic spirits, port wine, sherry, fruit juices and so on. The use of such containers for the bulk sale of wines, for example—as in half gallon or gallon quantities (or 2 liter or 4 liter packs)—is increasing and it is being found more important to ensure an adequate shelf life such that the contents, if wines, will be held in good condition for several months and will remain in good condition if consumed from time to time over yet an additional period of several months.

It is an object of this invention to provide an inner container of the nature described above, capable of being inserted into an outer container so as to constitute a composite container of the same general nature as those described in the U.S. Pat. Nos. 3,448,889 and 3,642,172 of C. H. Malpas, which may be filled with a liquid, and sealed in such manner that the liquid will come into contact with air to a minimum extent.

Another object is to provide an inner container of the nature described above which may be readily filled with a liquid, and sealed, without that liquid coming into contact with any more than a minimum quantity of air during the filling and sealing operations.

A further object is to provide an inner container of the nature described above which may be readily filled with liquid substantially without contact with air, sealed closed, and readily engaged in an outer container in readiness for storage, transport and sale.

Yet another object is to provide a composite container having an outer container and an inner container, of the nature described above, wherein the inner container has at one location means for securing it in fixed position relative to the outer container, wherein the inner container has liquid-filling means for enabling liquid to be fed into that container substantially without contact by air and to be sealed so that air cannot in ordinary circumstances have access to the liquid content, and wherein a tap for dispensing the contents of the inner container may be engaged therewith without permitting air to enter the inner container.

A still further object is to provide a construction of inner container, for a composite container of the general nature described above, which will enable a greater economy in production and facilitate the handling of the inner containers before, during and after the filling operation.

It is also an object of the invention to provide a construction of inner container, for a composite container of the general nature described above, which will enable the inner containers to be filled with the liquid contents and such filled containers stored and/or sold ready for fitting into outer containers.

The invention also has as one of its objects the provision of improved means for filling the inner containers with the liquids contents and for sealing the container from leakage after the inner container has been filled.

The inner container made according to this invention also provides the advantage that the means for fastening the inner container to the outer container are located on the outerside of the inner container, and there is nothing on the inner side of the container, and in contact with the contents thereof, which can cause contamination of such contents.

According to this invention there is provided a container for liquids—in the form of a collapsible inner container to be placed within a carton, can or other outer container to provide protection or a housing for the inner container—comprising a flexible bag-like member sealed around its edges and having attached to it at a suitable location a first socket ultimately for the withdrawal of liquid from the container and a second socket for use in filling the container with liquid, the first socket being closed by a frangible diaphragm and the second socket registering with an opening in a wall of the bag-like container whereby liquid may be fed through the second socket into the container.

Preferably, the bag-like container is made of a plastics ply material with the inner surface being of a plastics material such as a polyethylene which will not react with the liquid contents, and there being one layer to inhibit the passage of air to the liquid contents of the container. There may also be a layer of a somewhat stronger material, such as poly vinyl chloride or P.V.D.C.

In order that the invention may be more clearly understood and readily put into practical effect there shall now be described in detail a preferred construction of a container in accordance with the invention. The ensuing description is given by way of non-limitative example only and is with reference to the accompanying drawings, wherein:

FIG. 1 is a perspective view from one side of an inner container in accordance with the present invention, having two socket members appropriately positioned thereon;

FIG. 2 shows a longitudinal cross-section on the line and in the direction of the arrows 2—2 in FIG. 1;

FIG. 3 is a sectional view of a preferred material for use in the construction of an inner container in accordance with the present invention;

FIG. 4 shows a filling tube engaged with the filling socket, for the supply of liquid into said container;

FIG. 5 shows an enlarged view of the filling socket with filling tube attached, illustrating in more detail the filling of the inner container;

FIG. 6 is an enlarged view of the filling socket with filling tube engaged with it and having a sealing ring engaged with the upper side of the inner container so as to effect sealing of the container about the perimeter of the filling socket;

FIG. 7 depicts a filled, sealed collapsible container in accordance with the present invention;

FIG. 8 illustrates a modified arrangement of the filling socket in accordance with the present invention, the socket being shown in conjunction with a filled, sealed container as in FIG. 7; and FIGS. 9 and 10 show two alternative arrangements of the filling socket on the flexible container.

A collapsible container as shown in FIGS. 1 to 3, in accordance with the present invention, consists of a bag-like member C and two socket members 4 and 5. The bag-like member C is constructed from a laminated plastics material. In the embodiment shown the collapsible container is constructed from a ply material which incorporates a first or inner layer 1 of a material not subject to attack by the contents of the containers such as polyethylene, a substantially air-impervious intermediate layer 2 for restricting as much as possible the passage of air to the container contents such as bio-axially oriented nylons, and a third or outer-most layer 3 of a weldable material, such as for example polyvinyl chloride. In an especially preferred embodiment the inner layer 1 is of ethylvinylacetate polyethylene material, the intermediate layer 2 of bio-axially oriented nylon material (polyamide) and the outermost layer 3 of P.V.D.C. The container is bag-like in shape, with the two sides thereof, namely the back and front sides or surfaces or sheets, joined together around their peripheries by welding. However it should be understood that alternative means, such as for example the use of suitable adhesives, may be employed in order to achieve the desired joining.

The socket members 4 and 5 are made of plastics material suitable for adhesive fastening or fastening by welding to the outer layer 3 of the container, and are attached to the container C by use of a suitable adhesive, or by welding—adhesive fastening being preferred.

In the preferred embodiment the socket member 4 is attached to the front wall surface or sheet 6 of the bag-like container C, at a suitable distance from one end 6 thereof, and approximately midway between the respective sides of the container C.

The socket member 5 is attached, in the same manner as the socket member 4, to the same wall or sheet of the container C at the opposite end portion of said container. As shown in FIG. 1 it is attached to the container C adjacent one side edge, as shown in the modification of FIG. 9 it is attached adjacent one corner, and as shown in the modification of FIG. 10 it is attached adjacent one end edge, about the longitudinal centre line of the sheet.

The socket member 4 has a short, substantially cylindrical neck portion 7, an external flange 8 at one end of the neck, and an internal bead 11 at the other end. The other socket member 5 is similar in construction, having a neck 7 and an external flange 8 at one end, but it does not have the internal bead 11 at the other end.

In the making of the container C the front sheet 6 is formed with an opening 12 at the location required for the affixture of the socket 5, such that when the socket 5 is fastened in position the passageway or bore through the neck 7 will register with that opening 12, whereby liquid may be caused to flow through the socket member 5 into the interior of the container C. On the other hand, when the socket member 4 is attached to the sheet 6 of the container C a part of that sheet 6 will extend across the inner end of the socket member 4 so as to constitute a diaphragm closure, whereby liquid in the container C will be restrained from flowing through the socket member 4. However, as the sheet 6, although a ply, is relatively thin—the total thickness being about 0.001"—that diaphragm closure is readily frangible and may be punctured by a pointed or tapered inner end of a tap, such as is described in the specification of U.S. Pat. No. 3,642,172.

The socket member 4 is made to engage with a tap housing of design similar to the part 19 as illustrated and described in the U.S. Pat. No. 3,642,172, which part is capable of receiving a tap for dispensing the contents of the container C. Thus, the container provided by this invention may be used as the inner container in a composite container as defined in that U.S. Pat. No. 3,642,172. The tap housing therein defined includes a neck portion of substantially the same internal diameter as the external diameter of the socket member 4 with which it is to be engaged. At the innermost end of that neck portion there is provided an external beading, which beading is adapted to engage behind the internal bead 11 of the socket member 4 so as to hold the tap socket-member 4 firmly in position in that housing.

In order to fill the container made in accordance with the present invention, the flattened bag-like container as illustrated in FIG. 2, having a minimum of air within the container, is engaged with the upper end of a filling tube 9 extending from a machine for feeding liquid into the container (as shown in FIG. 4), the connection between the parts being substantially leak-proof. The filling machine is then operated so that a desired quantity of liquid is fed into the interior of the container C—see FIG. 5. By way of example, the container C may be made a size to receive one half-gallon of liquid, and the filling machine is set to shut off when a half-gallon of the liquid has been delivered to the container. Then a sealing member or ring 10, mounted co-axially with the filling tube 9 is caused to move so as to press together the front and back sheets of material of the container C—see FIG. 6—and those sheets are then electronically welded together at the location of the external flange 8 at the inner end of the socket member 5. That effectively closes the opening 12 in the sheet 6, and the liquid delivered to the interior of the container C is then sealed therein.

In a modified construction of a container in accordance with the present invention, as shown in FIG. 8, the socket member 5 is so engaged with the container C that the external flange 8 is welded to the inside of the front sheet 6 of the container C. When the container C has been filled with liquid and the sealing or welding operation is effected, the back sheet of the container C is sealed to the innermost surface of the external flange 8. That is to say, the flange is then sealed between the two sheets of the bag-like container. As described above, FIGS. 9 and 10 illustrate different locations on the bag-like container for the socket member 5. When the socket member is fastened at a corner location, as depicted in FIG. 9, the sealing off of the opening 12 may be effected by welding along a short line extending from one side edge to an end edge so as to isolate the socket member 5 and its associated opening 12 from the remainder of the container C having the liquid therein. In the arrangement depicted in FIG. 10 the relevant end of the container C is sealed off by welding along a line extending from one side edge of the container to the other. In either of these cases the welding or sealing operation may be so done that the small part including the socket member 5 may be readily detached prior to the sale of the filled container.

As the container C is made in a flattened condition such that there is a minimum of air within it at the time when the filling operation is commenced, and as the socket members 4 and 5 are fastened to it on the outside of the sheet 6 it is clear the interior of the container should be free of contamination immediately before the filling operation. Provided the liquid fed into the container is also uncontaminated it is clear the filled container should be free of contamination such that the contents may be kept in good condition for a relatively long period.

The filled inner container may be readily placed in a carton, can, plastics barrel or other outer container and the socket 4 engaged with a fitting for holding that socket member in fixed position in the outer container such that a tap for dispensing the contents may be engaged therein to pierce the frangible diaphragm across the inner end of the socket, somewhat as described in the U.S. Pat. No. 3,642,172.

What I claim is:

1. A flexible, collapsible container filled with liquid, said liquid being subject to deterioration when exposed to air, comprising a construction wherein first and second sheets of plastics ply material are sealed together around their entire peripheries, said first sheet having an aperture provided therein and a first socket member fastened thereto in registration with said aperture for filling said container with liquid, and wherein a second socket member is fastened to said container at a location to allow for dispensing of liquid contents from said container, said second socket member being fastened to one of said sheets of plastics ply material such that a portion of said one sheet extends across the innermost end of said second socket member thereby defining a frangible diaphragm, said second sheet being fused to said first sheet around the entire periphery of said aperture to isolate said first socket member and said aperture and thereby prevent escape of liquid from the interior of said container to said filling aperture, said construction minimizing the quantity of air residual in said container prior to filling and the quantity of air and other contaminants introduced into said container during filling.

2. The container of claim 1 wherein each of said socket members includes a neck portion defining a passageway therethrough and an external flange provided at the innermost end of said neck portion, each said socket member being secured to said container via said flange.

3. The container of claim 2 wherein said flange of said first socket member is secured to the internal surface of said sheet of plastic material.

4. A method of filling a flexible, collapsible container having first and second sheets of plastic ply material sealed together around their entire peripheries, said first sheet having an aperture provided therein and a first socket member fastened thereto in registration with said aperture, and a second socket member fastened to said container, said second socket member being fastened to one of said sheets of plastic ply material such that a portion of said one sheet extends across the innermost end of said second socket member thereby defining a frangible diaphragm, comprising the steps of: withdrawing substantially all of the air from the interior of said container through said aperture and said first socket member; engaging the first socket member of said container with a filler tube; supplying a predetermined metered quantity of liquid from said filler tube to the interior of said container via said first socket member and said aperture; and applying a sealing member against the second sheet thereby bringing said second sheet in contact with the peripheral area adjacent said aperture of said first sheet while maintaining said filler tube in engagement with said first socket member and sealing together the two sheets of said container in a continuous line adjacent said first socket member and around the entire periphery of said aperture to isolate said first socket member and said aperture from the contents of said filled container thereby preventing the escape of liquid from said container.

* * * * *